US011154088B2

(12) United States Patent
Kadiric

(10) Patent No.: US 11,154,088 B2
(45) Date of Patent: Oct. 26, 2021

(54) SMOKING ARTICLE WITH IMPROVED EXTINGUISHMENT

(71) Applicant: PHILIP MORRIS PRODUCTS S.A., Neuchatel (CH)

(72) Inventor: Alen Kadiric, Orpund (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 15/736,043

(22) PCT Filed: Jun. 30, 2016

(86) PCT No.: PCT/EP2016/065402
§ 371 (c)(1),
(2) Date: Dec. 13, 2017

(87) PCT Pub. No.: WO2017/001613
PCT Pub. Date: Jan. 5, 2017

(65) Prior Publication Data

US 2018/0160726 A1 Jun. 14, 2018

(30) Foreign Application Priority Data

Jun. 30, 2015 (EP) ..... 15174662

(51) Int. Cl.
*A24D 3/04* (2006.01)
*A24D 1/02* (2006.01)

(52) U.S. Cl.
CPC *A24D 3/04* (2013.01); *A24D 1/02* (2013.01)

(58) Field of Classification Search
CPC ..... A24D 3/04; A24D 1/02
See application file for complete search history.

(56) References Cited

U.S. PATENT DOCUMENTS 2,804,078 A * 8/1957 Saffir ..... A24D 1/04 131/344
3,486,508 A 12/1969 Sipos
(Continued)

FOREIGN PATENT DOCUMENTS

CN 101808541 8/2010
CN 103763949 4/2014
(Continued)

OTHER PUBLICATIONS

International Search Report and Written Opinion for PCT/EP2016/065402 dated Sep. 26, 2016 (10 pages).
(Continued)

*Primary Examiner* — Michael H. Wilson
*Assistant Examiner* — Guy F Mongelli
(74) *Attorney, Agent, or Firm* — Mueting Raasch Group

(57) ABSTRACT

A smoking article (10) comprises a tobacco rod (11) and a filter (12) in axial alignment with the tobacco rod (11). Tipping wrapper (16) circumscribes at least a portion of the filter (12) and at least a portion of the tobacco rod (11) to secure the filter (12) in axial alignment with the tobacco rod (11). The filter (12) comprises a hollow tubular element (13) at the upstream end of the filter (12) adjacent to the tobacco rod (11) and a first segment of filtration material (15) downstream from and adjacent to the hollow tubular element (13). The tipping wrapper (16) comprises a line of weakness (17) disposed at, or within 5 millimetres upstream of, the interface between the hollow tubular element (13) and the tobacco rod (11). The tobacco rod (11), the first segment of filtration material (15) and the inner surface of the hollow tubular element (13) together define a cavity (14). The cavity (14) is designed to receive the lit end of the smoking article (10) and any unburnt tobacco material when the consumer chooses to extinguish the smoking article (10).

17 Claims, 1 Drawing Sheet

(56) References Cited

U.S. PATENT DOCUMENTS

| | | | | | |
|---|---|---|---|---|---|
| 4,388,934 | A * | 6/1983 | Luke | A24D 3/04 | 131/339 |
| 4,715,390 | A * | 12/1987 | Nichols | A24B 15/281 | 131/335 |
| 4,776,354 | A | 10/1988 | Norman | | |
| 4,869,275 | A * | 9/1989 | Berger | A24D 3/0237 | 131/332 |
| 4,920,990 | A | 5/1990 | Lawrence | | |
| 5,107,863 | A * | 4/1992 | Nyffeler | A24D 3/04 | 131/338 |
| 7,624,739 | B2 | 12/2009 | Snaidr | | |
| 7,793,665 | B2 | 9/2010 | Dube | | |
| 7,980,250 | B2 | 7/2011 | Clarke | | |
| 9,060,546 | B2 | 6/2015 | Li | | |
| 9,185,939 | B2 | 11/2015 | Jarriault | | |
| 10,123,561 | B2 * | 11/2018 | Kadiric | A24C 5/476 | |
| 10,285,434 | B2 | 5/2019 | Fallon | | |
| 10,609,955 | B2 | 4/2020 | Alderman | | |
| 2002/0153017 | A1 * | 10/2002 | Georgitsis | A24D 3/0225 | 131/331 |
| 2004/0261807 | A1 | 12/2004 | Dube | | |
| 2008/0302376 | A1 | 12/2008 | Allen | | |
| 2008/0314399 | A1 * | 12/2008 | Ricketts | A24D 1/00 | 131/331 |
| 2009/0007925 | A1 * | 1/2009 | Rasouli | A24D 3/04 | 131/275 |
| 2010/0108084 | A1 * | 5/2010 | Norman | A24D 1/02 | 131/338 |
| 2012/0255569 | A1 * | 10/2012 | Beard | A24D 3/04 | 131/334 |
| 2012/0305014 | A1 * | 12/2012 | Richardson | A24D 3/04 | 131/284 |
| 2012/0325230 | A1 * | 12/2012 | Parrish | A24D 1/02 | 131/331 |
| 2013/0112216 | A1 * | 5/2013 | Clarke | A24F 13/06 | 131/331 |
| 2013/0140197 | A1 | 6/2013 | Fiebelkorn | | |
| 2013/0206151 | A1 * | 8/2013 | Besso | A24B 15/283 | 131/275 |
| 2014/0290678 | A1 * | 10/2014 | Besso | A24D 3/048 | 131/337 |
| 2014/0299144 | A1 * | 10/2014 | Fiebelkorn | A24D 1/025 | 131/336 |
| 2014/0305448 | A1 | 10/2014 | Zuber | | |
| 2014/0332014 | A1 * | 11/2014 | Penrose | A24D 3/061 | 131/274 |
| 2015/0027474 | A1 * | 1/2015 | Zuber | A24D 3/10 | 131/329 |
| 2015/0144149 | A1 * | 5/2015 | Blangy | A24D 3/04 | 131/336 |
| 2015/0208720 | A1 * | 7/2015 | Kadiric | A24D 3/17 | 131/281 |
| 2015/0342254 | A1 * | 12/2015 | Mironov | A24D 1/22 | 131/330 |
| 2018/0160726 | A1 | 6/2018 | Kadiric | | |

FOREIGN PATENT DOCUMENTS

| | | |
|---|---|---|
| CN | 103781373 | 5/2014 |
| CN | 104010531 | 8/2014 |
| CN | 104203015 | 12/2014 |
| CN | 104270970 | 1/2015 |
| CN | 104519760 | 4/2015 |
| EA | 15068 | 4/2011 |
| EP | 0370335 | 5/1990 |
| EP | 2740370 | 6/2014 |
| EP | 2783590 | 10/2014 |
| FR | 2497636 | 7/1982 |
| GB | 781654 | * 11/1954 |
| GB | 873982 | * 12/1957 |
| JP | 2-190173 | 7/1990 |
| JP | 11-346748 | 12/1999 |
| JP | 2007-520204 | 7/2007 |
| RU | 2324409 | 1/2006 |
| RU | 115166 | 4/2012 |
| RU | 2705478 | 11/2019 |
| TW | 362958 | 7/1999 |
| WO | WO 2009/007258 | 1/2009 |
| WO | WO 2014/068295 | 5/2014 |
| WO | WO 2014/158051 | 10/2014 |
| WO | WO 2016/156209 | 10/2016 |

OTHER PUBLICATIONS

European Extended Search Report for Application No. 15174662.5 dated Sep. 18, 2015 (8 pages).
Office Action issued in Taiwan for Application No. 105119929 dated Nov. 19, 2019 (15 pages). English translation included.
Office Action issued in Russia for Application No. 2018102698 dated Aug. 27, 2019 (17 pages). English translation included.
Office Action issued in China for Application No. 201680034682.5 dated Mar. 3, 2020 (18 pages). English translation included.
Office Action issued in Russia for Application No. 2019134386 dated Jun. 17, 2020 (10 pages). English translation included.
Office Action issued in Japan for Application No. 2017-564576 dated Aug. 11, 2020 (6 pages). English translation included.
Office Action issued in China for Application No. 201680034682.5 dated Oct. 28, 2020 (18 pages). English translation included.

* cited by examiner

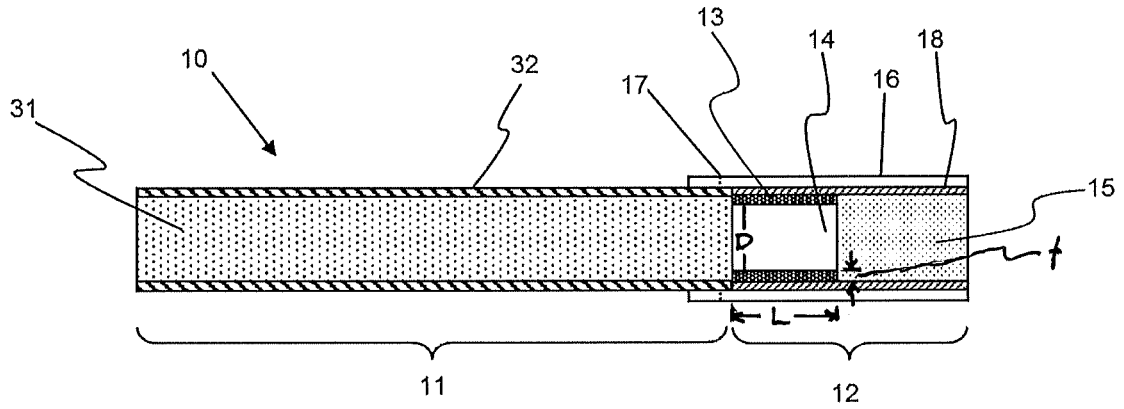
10
31
32
13
14
17
16
18
15
D
t
L
11
12

SMOKING ARTICLE WITH IMPROVED EXTINGUISHMENT

This application is a U.S. National Stage Application of International Application No. PCT/EP2016/065402, filed Jun. 30, 2016, which was published in English on Jan. 5, 2017, as International Publication No. WO 2017/001613 A1. International Application No. PCT/EP2016/065402 claims priority to European Application No. 15174662.5, filed Jun. 30, 2015.

The present invention relates to smoking articles (for example cigarettes). Filter cigarettes typically comprise a rod of tobacco cut filler surrounded by a paper wrapper and a cylindrical filter aligned in end-to-end relationship with the wrapped tobacco rod, with the filter attached to the tobacco rod by tipping paper. In conventional filter cigarettes, the filter may consist of a plug of cellulose acetate tow wrapped in porous plug wrap. Filter cigarettes with multi-component filters that comprise two or more segments of filtration material for the removal of particulate and gaseous components of the mainstream smoke are also known.

Generally, a consumer smokes a smoking article until the burning area of the tobacco rod (the lit end) reaches the edge of the tipping paper. This means that a small portion of the tobacco (where the tipping paper overlaps the tobacco rod) still remains unburnt and will continue to burn unless extinguished. Therefore, the consumer extinguishes the smoking article, typically by holding the filter and pressing the lit end of the smoking article against the base of an ashtray or other hard non-flammable surface. This disrupts the structure of the lit end and prevents oxygen reaching the burning tobacco, and burning usually stops rapidly. However, in the process of extinguishing the smoking article, the consumer's fingers may come into contact with, or close to, the lit end of the smoking article or old ash remaining in the ashtray.

Several solutions have therefore been proposed for extinguishing a smoking article in a safe, hygienic way. For example, it has been proposed to modify the burning characteristics of the paper surrounding the tobacco rod at or around its downstream end, so that the cigarette will effectively self-extinguish when the lit end reaches this modified section. However, in some circumstances, a consumer may wish to extinguish the cigarette before the lit end reaches the modified section of the wrapper, and thus need to extinguish the cigarette manually. Furthermore, the modified section may not always extinguish the lit end in a quick and reliable manner. In addition, such an arrangement will still result in loose ash being left in the ashtray.

An alternative proposed solution is to provide a tube or sleeve that can slide over a smoking article and cover the lit end of the tobacco rod to extinguish the smoking article, after a consumer has finished smoking the smoking article. However, such tubes can hinder or undesirably affect the function of the smoking article during smoking.

It would therefore be desirable to provide a solution for extinguishing a smoking article in safe and hygienic way, without hindering or undesirably affecting the function of the smoking article during smoking.

Accordingly, the present invention provides a smoking article comprising a tobacco rod; a filter in axial alignment with the tobacco rod; and a tipping wrapper circumscribing at least a portion of the filter and at least a portion of the tobacco rod to secure the filter in axial alignment with the tobacco rod, wherein the filter comprises: a hollow tubular element at the upstream end of the filter adjacent to the tobacco rod; and a first segment of filtration material downstream from and adjacent to the hollow tubular element. It is understood that the inner surface of the hollow tubular element, the downstream end of the tobacco rod and the upstream end of the first segment of filtration together define the boundary of an internal cavity within the filter.

The provision of a hollow tubular element at the upstream end of the filter, adjacent the tobacco rod allows the consumer to easily extinguish the smoking article by, for example, holding the filter and pressing the lit end of the smoking article against a hard non-flammable surface, such as an ashtray. This pushes the lit end of the smoking article and any unburnt tobacco into the cavity of the hollow tubular element. The portion of the tipping paper that circumscribes the tobacco rod and any remaining cigarette paper may also be pushed into the cavity of the hollow tubular element. This can minimise the likelihood of the ash or the lit end coming into contact with a consumer's fingers and may also reduce the amount of loose material, such as ash, created during the act of extinguishing the smoking article. This can also reduce the oxygen supply to the lit end, and thereby improve the rate at which the smoking article is extinguished.

As used herein, the terms "upstream" and "downstream" are used to describe relative positions between elements of the filter or smoking article in relation to the direction of mainstream smoke as it is drawn from a lit end of the smoking article through the filter. Mainstream smoke flows generally parallel to the length of the smoking article, in the longitudinal direction. The transverse direction of the smoking article is perpendicular to the longitudinal direction.

As used herein, the term "inner surface" is used to describe the side of the hollow tubular element that faces towards the inside of the filter.

As used herein, the term "buckling strength" refers to the axial compressive load on the smoking article filter at which the filter will collapse or buckle. This load may be caused by the consumer pressing the lit end of the smoking article against the base of an ashtray or other hard non-flammable surface.

As used herein, the term "filling power" is used to describe the volume of space taken up by a given weight or mass of a tobacco material. The greater the filling power of a tobacco material, the lower the weight of the material required to fill a tobacco rod of standard dimensions. The values of filling power are expressed in terms of corrected cylinder volume (CCV) which is the cylinder volume (CV) of the tobacco material at a reference moisture level of 12.5 percent oven volatiles. The cylinder volume (CV) may be determined using a Borgwaldt densimeter DD60 or DD60A type fitted with a measuring head for cut tobacco and a tobacco cylinder container.

Preferably, the hollow tubular element has a (wall) thickness (t) perpendicular to the longitudinal direction of the smoking article of from about 100 micrometers to about 700 micrometers. More preferably, the hollow tubular element has a thickness (t) perpendicular to the longitudinal direction of the smoking article of from about 150 micrometers to about 400 micrometers, and even more preferably from about 200 micrometers to about 300 micrometers. In some preferred embodiments, the hollow tubular element has a thickness (t) perpendicular to the longitudinal direction of the smoking article of about 250 micrometers.

The provision of a hollow tubular element having a thickness (t) perpendicular to the longitudinal direction of the smoking article within the aforementioned ranges reduces the risk of the hollow tubular element collapsing or deforming when the consumer extinguishes the smoking article by, for example, pressing the lit end against a hard non-flammable surface. Furthermore, this also helps prevent the tobacco of the tobacco rod from entering the upstream end of the hollow tubular element before the consumer chooses to extinguish the smoking article. In addition, this provision can help to prevent the first segment of filtration material from entering the downstream end of the hollow tubular element when the consumer extinguishes the smoking article. The provision of a hollow tubular element having a thickness (t) perpendicular to the longitudinal direction of the smoking article within the aforementioned range can also ensure that the internal cavity of the hollow tubular element is large enough to receive the lit end of the smoking article and any unburnt tobacco, thereby minimising the likelihood of the ash or the lit end coming into contact with a consumer's fingers.

Preferably, the hollow tubular element is formed from a material with a grammage of from about 50 grams per square metre to about 250 grams per square metre, more preferably from about 80 grams per square metre to about 150 grams per square metre. In certain preferred embodiments, the hollow tubular element is formed from a material with a grammage of about 100 grams per square metre.

The provision of a hollow tubular element having a grammage within the aforementioned ranges can increase the buckling strength of the hollow tubular element, which can in turn help to reduce the risk of the hollow tubular element collapsing or deforming when the consumer extinguishes the smoking article.

Preferably, the hollow tubular element has a length (L) from about 3 millimetres to about 20 millimetres. More preferably, the hollow tubular element has a length of from about 4 millimetres to about 15 millimetres, even more preferably, from about 5 millimetres to about 10 millimetres. In some preferred embodiments, the hollow tubular element has a length of about 6 millimetres.

The provision of a hollow tubular element having a length greater than about 4 millimetres may help enable the internal cavity of the hollow tubular element to be large enough to receive the lit end of the smoking article and any unburnt tobacco thereby minimising the likelihood of the ash or the lit end coming into contact with a consumer's fingers.

Preferably, the hollow tubular element has a length that is greater than or equal to the length of the portion of the tipping wrapper that circumscribes the tobacco rod. This can ensure that any loose tobacco that underlies the portion of the tipping wrapper that circumscribes the tobacco rod is able to fit inside the hollow tubular element when the smoking article is extinguished.

Preferably, the tipping wrapper comprises a line of weakness disposed at, or within 5 mm upstream of the interface between the hollow tubular element and the tobacco rod, more preferably disposed at, or within 2 mm upstream of, the interface between the hollow tubular element and the tobacco rod. The line of weakness can enable the portion of the tipping wrapper that circumscribes the tobacco rod to buckle or otherwise deform when the consumer presses the lit end of the smoking article against the base of an ashtray or other hard non-flammable surface to extinguish it. This deformation can help the lit end of the smoking article and any unburnt tobacco enter the cavity of the hollow tubular element when the consumer extinguishes the smoking article. This can increase the likelihood of any buckling during extinguishment being localised to the portion of the smoking article immediately upstream of the hollow tubular element. As a result, the consumer can use less force to extinguish the smoking article, and be less likely to deform the filter during extinguishment.

As noted above, the line of weakness is provided to enable the portion of the tipping wrapper that circumscribes the tobacco rod to buckle or otherwise deform when the consumer presses the lit end of the smoking article against the base of an ashtray or other hard non-flammable surface to extinguish it. This can either result in the tipping wrapper separating along the line of weakness, in which case a portion of the tipping wrapper can also be pushed into the cavity of the hollow tubular element with the loose tobacco and the lit end of the smoking article. Alternatively, this can result in the portion of the tipping wrapper that circumscribes the tobacco rod folding along the line of weakness, in which case, the portion of tipping wrapper that circumscribes the tobacco rod will remain attached to the filter and for a sleeve that can help guide the lit end of the tobacco rod and any unburnt tobacco into the hollow tubular element.

As noted above a line of weakness is preferably disposed at, or within 5 millimetres upstream of, the interface between the hollow tubular element and the tobacco rod. In some embodiments, the line of weakness is disposed at the interface between the hollow tubular element and the tobacco rod. In some alternative embodiments, the line of weakness is disposed between about 0.5 millimetres and about 5 millimetres upstream of the interface between the hollow tubular element and the tobacco rod, more preferably between about 1 millimetre and about 2 millimetres upstream of the interface between the hollow tubular element and the tobacco rod.

In some embodiments there is more than one line of weakness disposed at, or within 5 millimetres upstream of, the interface between the hollow tubular element and the tobacco rod. For example, there may be between about two and about five lines of weakness. This may allow greater control over the deformation of the portion of the tipping wrapper that circumscribes the tobacco rod.

The line of weakness may be formed in the tipping wrapper before or after it is wrapped around the tobacco rod and the filter. In some embodiments, the line of weakness is formed in the tipping wrapper before it is wrapped around the tobacco rod and filter. This can simplify the manufacturing process. Appropriate types of lines of weakness include but are not limited to, embossed lines, debossed lines, creases, lines of perforation holes or combinations thereof.

In some preferred embodiments according to the invention, the line of weakness comprises a plurality of perforation holes.

The perforation holes may be any size. Preferably the plurality of perforation holes have a diameter of between about 0.2 micrometres and about 1.2 micrometers, more preferably between about 0.3 micrometers and about 1 micrometers, even more preferably, between about 0.5 micrometers and about 0.9 micrometers. In some preferred embodiments, the perforation holes have a diameter of about 0.8 micrometres.

The plurality of perforation holes may be substantially the same size or may be substantially different sizes. Preferably, the perforation holes are substantially the same size. This can help to encourage the portion of the tipping wrapper that circumscribes the tobacco rod to deform evenly when the smoking article is extinguished. Each perforation hole may have any suitable shape, such as a round or oval shape.

The provision of the line of weakness comprising a plurality of perforation holes according to the dimensions outlined above can help ensure that the line of weakness will allow the portion of the tipping wrapper that circumscribes the tobacco rod to deform under normal extinguishing conditions while preventing the portion of the tipping wrapper that circumscribes the tobacco rod from deforming before the consumer chooses to extinguish the smoking article.

In some embodiments of the invention, the smoking article further comprises a flavour delivery mechanism configured to release flavourant when a consumer extinguishes the smoking article. Preferably, the flavour delivery mechanism is provided on or near the filter portion of the smoking article. This can allow at least one of the mainstream smoke or the sidestream smoke to become flavoured or aromatised when the smoking article is being extinguished. For example, a flavour delivery mechanism provided on the inner surface of the tubular element, configured to release flavorant when a consumer extinguishes the smoking article may cause the sidestream smoke to become flavoured or aromatised when the smoking article is extinguished. This can flavour or aromatise the air surrounding the extinguished smoking article and counter or mask any undesirable smells created by the act of extinguishment.

The flavourant may be in any suitable form, for example the flavourant may be a liquid flavorant, a powdered flavorant or combinations thereof. Suitable flavourants include, but are not limited to, materials that contain natural or synthetic-, menthol, mint, such as peppermint and spearmint, *eucalyptus*, sage, chocolate, liquorice, citrus and other fruit flavourants, gamma octalactone, vanillin, ethyl vanillin, breath freshener flavourants, spice flavourants such as cinnamon, methyl salicylate, linalool, bergamot oil, geranium oil, lemon oil, ginger oil, and tobacco flavourant. Other suitable flavourants may include flavourant compounds selected from the group consisting of an acid, an alcohol, an ester, an aldehyde, a ketone, a pyrazine, combinations or blends thereof and the like. Other suitable flavourants may include flavourant compounds selected from the group consisting of an acid, an alcohol, an ester, an aldehyde, a ketone, a pyrazine, combinations or blends thereof and the like.

The flavour delivery mechanism may have a structure in which a structural material releasably encloses a flavourant or flavourants. For example, in some embodiments, the flavour delivery mechanism comprises a matrix structure defining a plurality of domains, the flavourant being trapped within the domains until released when a consumer extinguishes the smoking article.

In some embodiments, the flavour delivery mechanism is provided on the hollow tubular element. For example, the flavour delivery mechanism may be provided on the inner surface or the outer surface of the hollow tubular element. Preferably, the flavour delivery mechanism is provided on the inner surface of the hollow tubular element, and configured to release flavorant when a consumer extinguishes the smoking article. This can allow the material that is inserted into the cavity of the hollow tubular element to directly contact the flavour delivery mechanism and cause flavour to be released.

The flavour delivery mechanism may comprise a flavorant on the inner surface of the hollow tubular element. Alternatively or in addition, the flavour delivery mechanism may be provided by a surface treatment process on the inner surface of the hollow tubular element.

As noted above, the smoking article preferably comprises a flavour delivery mechanism that is configured to release flavourant when a consumer extinguishes the smoking article. For example, the extinguishment may initiate one or more trigger events that result in the flavour delivery mechanism releasing flavourant. The one or more trigger events may be selected from the group consisting of the application of frictional force, the addition of moisture, a change of pH, a temperature increase, and any combination thereof. The application of frictional force may include application of frictional force to the inner surface of the hollow tubular element, application of frictional force to the outer surface of the tipping paper, or both.

In certain preferred embodiments, the flavour delivery mechanism is configured to release flavourant when the tobacco rod is burnt beyond a certain point. In this embodiment, the flavour delivery mechanism may be configured to release flavorant in response to a temperature increase.

Alternatively, or in addition, the flavour delivery mechanism is configured to release flavourant when the smoking article is extinguished by the consumer by pressing the lit end of the smoking article against the base of an ashtray or other hard non-flammable surface. In this embodiment, the flavour delivery mechanism may be configured to release flavorant in response to the application of frictional force on the inner surface of the hollow tubular element.

In some preferred embodiments, the hollow tubular element is preferably formed from a paper material. More preferably, the hollow tubular element is formed from a plurality of overlapping paper layers, such as a plurality of parallel wound paper layers or a plurality of spirally wound paper layers. Forming the hollow tubular element from a plurality of overlapping paper layers can help to improve the buckling strength of the hollow tubular element. This means that the hollow tubular element is less likely to buckle or otherwise deform when the user extinguishes the smoking article.

Preferably, the hollow tubular element comprises at least two paper layers. Preferably, the hollow tubular element comprises fewer than eleven paper layers. This can help to ensure the hollow tubular element has an appropriate buckling strength while minimising the amount of material used in the smoking article.

An exemplary method for forming a tube segment from a plurality of spirally wound paper layers comprises wrapping a plurality of substantially continuous paper strips in an overlapping manner about a cylindrical mandrel. The strips are wrapped in a spiral manner so as to form a substantially continuous tube on the mandrel. The formed tube may be turned about the mandrel, for example using a rubber belt, so that the paper layers are continually drawn and wrapped around the mandrel. The formed tube can then be cut into the required lengths downstream of the mandrel.

In embodiments according to the invention, the hollow tubular element is formed from an annular shaped segment of filtration material. The filtration material may be any filtration material, such as cellulose acetate. The annular shaped segment of filtration material has a hollow core extending from the upstream end of the annular shaped segment to the downstream end of the annular shaped segment. Such a segment may be referred to as a hollow acetate tube.

Preferably, the filtration material of the annular shaped segment is of high particulate efficiency. Preferably, the filtration material of the annular shaped segment comprises fibres of between approximately 1.5 denier per filament (dpf) and approximately 5 dpf, more preferably between approximately 1.5 denier per filament (dpf) and approximately 3 dpf. In a preferred embodiment, the filtration material of the annular shaped segment comprises fibres of approximately 3.3 dpf.

Preferably, the filtration material of the annular shaped segment comprises fibres of between approximately 30,000 total denier (td) and approximately 50,000 td, more preferably between 35,000 total denier (td) and approximately 50,000 td. In a preferred embodiment, the filtration material of the annular shaped segment comprises fibres of approximately 44,000 td.

Preferably, the hollow tube segment comprises one or more plasticisers. Suitable plasticisers include triacetin, and triethyleneglycol di-acetate. Preferably, the plasticiser is present in the annular shaped segment in an amount of between about 5 and about 15 percentage weight, more preferably between about 8 and about 12 percentage weight.

The provision of the hollow tubular element being formed from an annular shaped segment of filtration material having the aforementioned particulate efficiency, fibre denier and plasticiser, can improve the buckling strength of the hollow tubular element.

Preferably, the hollow tubular element has a thickness (t) perpendicular to the longitudinal direction of the smoking article, and a diameter (D) perpendicular to the longitudinal direction of the smoking article, and wherein the diameter (D) to thickness (t) ratio is less than about 80. Preferably, the hollow tubular element has a diameter (D) to thickness (t) ratio of less than about 75, more preferably, less than about 40. This can increase the buckling strength of the hollow tubular element which may reduce the risk of the hollow tubular element buckling, collapsing or otherwise deforming when the consumer extinguishes the smoking article. It has been observed that, for a given height, the buckling strength of hollow tubular elements may be considerably increased by decreasing the ratio of D:t. This allows the smoking article to be extinguished by a consumer while considerably reducing the chance of the hollow tubular element buckling under the compressive load. Preferably, the hollow tubular element has an diameter (D) to thickness (t) ratio of greater than about 10, more preferably, greater than about 20. This can help to ensure that internal cavity of the hollow tubular element is large enough to receive the lit end of the smoking article and any unburnt tobacco minimising the likelihood of the ash or the lit end coming into contact with a consumer's fingers.

In some embodiments according to the invention, the filter further comprises a filter wrapper circumscribing at least the hollow tubular element and the first segment of filtration material, the filter wrapper being disposed between the tipping wrapper, and the hollow tubular element and the first segment of filtration material. Furthermore, the provision of a filter wrapper may help prevent the hollow tubular element and the first segment of filtration material from separating in use or when the consumer chooses to extinguish the smoking article. This is particularly relevant if the hollow tubular element and the first segment of filtration material are adhered to the filter wrapper.

Preferably, the filter wrapper circumscribes the full length of the hollow tubular element. Preferably, the filter wrapper circumscribes the full length of the first segment of filtration material.

Examples of suitable filter wrapper materials include, but are not limited to, cellulose based materials, paper, cardboard, recon, cellulose based film, and combinations thereof.

Preferably, the tobacco rod comprises tobacco material circumscribed by a tobacco rod wrapper.

Any suitable tobacco material may be used. For example, the tobacco material may comprise tobacco cut filler. Preferably, at the downstream end of the tobacco rod, the cut filler has a filling power of at least about 3.5 cubic centimetres per gram at a reference moisture value of 12.5 percent oven volatiles. More preferably, at the downstream end of the tobacco rod, the cut filler has a filling power of at least about 4 cubic centimetres per gram at a reference moisture value of 12.5 percent oven volatiles. In addition, or as an alternative, at the downstream end of the tobacco rod the cut filler preferably has a filling power of less than about 8 cubic centimetres per gram at a reference moisture value of 12.5 percent oven volatiles. More preferably, at the downstream end of the tobacco rod the cut filler has a filling power of less than about 7 cubic centimetres per gram at a reference moisture value of 12.5 percent oven volatiles. In some particularly preferred embodiments, at the downstream end of the tobacco rod the cut filler has a filling power of from about 3.5 cubic centimetres per gram to about 8 cubic centimetres per gram at a reference moisture value of 12.5 percent oven volatiles. This can reduce the likelihood of the tobacco cut filler entering the cavity of the hollow tubular element without greatly affecting the combustion properties of the tobacco rod.

Alternatively, or in addition, the tobacco material may comprise a crimped tobacco cast leaf at the downstream end of the tobacco rod. This can help to stop tobacco material from entering the cavity of the hollow tubular element without greatly affecting the combustion properties of the tobacco rod.

The tobacco rod wrapper may comprise any appropriate material. Preferably, the tobacco rod wrapper is formed from cigarette paper.

In some embodiments according to the invention, the filter further comprises one or more segments of filtration material downstream from the first segment of filtration material.

The one or more segments of filtration material downstream from the first segment of filtration material may abut the first segment of filtration material. Alternatively, the one or more segments of filtration material downstream from the first segment of filtration material may be separated from the first segment of filtration material by a further component or a cavity.

The first segment of filtration material and the one or more segments of filtration material downstream from the first segment of filtration material may comprise any suitable filtration material or combination of filtration materials. The type of filtration material may be selected to provide the desired level of RTD (resistance to draw) during smoking and the desired level of hardness and ovality after deformation. Examples of suitable materials include, but are not limited to, cellulose acetate, cellulose, reconstituted cellulose, polylactic acid, polyvinyl alcohol, nylon, polyhydroxybutyrate, thermoplastic material, such as starch, non-woven materials, longitudinally oriented fibres and randomly oriented fibres, paper, crepe, PLA fibres, and combinations thereof. One or more of the materials may be formed into an open cell structure. All or part of the first segment of filtration material and the one or more segments of filtration material downstream from the first segment of filtration material may include activated carbon or other sorbent material. The first segment of filtration material and the one or more segments of filtration material downstream from the first segment of filtration material may include an adhesive or plasticiser or a combination thereof. The first segment of filtration material and the one or more segments of filtration material downstream from the first segment of filtration material may be compressible. The first segment of filtration material and the one or more segments of filtration material downstream from the first segment of filtration material may comprise the same filtration material. Alternatively they may comprise different filtration materials. In preferred embodiments, the one or more segments of filtration material downstream from the first segment of filtration material comprises a plug of cellulose acetate tow.

Alternatively, or in addition, the filter comprises a mouth end cavity at its downstream end. The mouth end cavity may abut the first segment of filtration material. Alternatively, if present, the mouth end cavity may abut the one or more segments of filtration material located downstream of the first segment of filtration material. The mouth end cavity may be formed from a section of spirally wound paper layers. Alternately, or in addition, the mouth end cavity may be formed from an annular section filtration material. Alternately, or in addition, the mouth end cavity may be formed by the downstream end of the tipping material.

Preferably, the first segment of filtration material comprises a plug of cellulose acetate tow.

Preferably, the axial stiffness of the hollow tubular element is greater than or equal to the axial stiffness of the tobacco rod. This can reduce the likelihood of the hollow tubular element buckling before the tobacco rod buckles, during extinguishment.

The invention will now be further described, by way of example only, with reference to the accompanying drawings in which:

FIG. 1 shows a smoking article in accordance with an embodiment of the present invention FIG. 1 shows a smoking article 10 having an upstream end and a downstream end and comprising a tobacco rod 11 which is attached at its downstream end to an axially aligned filter 12. The tobacco rod 11 comprises a charge of cut filler 31 that is circumscribed by a tobacco rod wrapper 32. The filter 12 comprises a hollow tubular element 13 and a single segment of cellulose acetate tow 15 which abuts the hollow tubular element 13. The hollow tubular element 13 abuts the tobacco rod 11 such that a cylindrical internal cavity 14 is defined by the inner surface of the hollow tubular element 13, the single segment of cellulose acetate tow 15 and the tobacco rod 11. The filter 12 and a portion of the tobacco rod 11 are circumscribed by tipping wrapper 16. The length of the portion of the tobacco rod 11 that is circumscribed by tipping wrapper 16 is less than the length of the hollow tubular element 13. A line of weakness is provided in the tipping wrapper 16, in the form of a plurality of perforations 17. The plurality of perforations are located 1 millimetre upstream from the downstream end of the tobacco rod 11. The hollow tubular element 13 and the single segment of cellulose acetate tow 15, are both circumscribed by a filter wrapper 18 that is in turn circumscribed by the tipping wrapper 16.

In use, the consumer lights the upstream end of the tobacco rod 11 and draws through the downstream end of the single segment of cellulose acetate tow 15. When the consumer chooses to extinguish the smoking article 10, the smoking article 10 is held by the filter 12 and the lit end of the tobacco rod 11 is pressed against the base of an ashtray or other hard non-flammable surface. When this is done, the tipping wrapper 16 will bend or separate along the line of the plurality of perforations 17. This helps the lit end of the tobacco rod and any unburnt tobacco to be pushed into the cavity 14 of the hollow tubular element 13. This helps to extinguish the smoking article 10 by preventing oxygen reaching the lit end of the tobacco rod 11.

The invention claimed is:

1. A smoking article comprising:

a tobacco rod;

a filter in axial alignment with the tobacco rod; and a tipping wrapper circumscribing at least a portion of the filter and at least a portion of the tobacco rod to secure the filter in axial alignment with the tobacco rod, wherein the filter comprises:

a hollow tubular element at an upstream end of the filter adjacent to the tobacco rod; and a first segment of filtration material downstream from and adjacent to the hollow tubular element; and wherein the tipping wrapper comprises a line of weakness circumferentially disposed around the smoking article;

wherein the line of weakness is disposed:

at an interface between the hollow tubular element and the tobacco rod, or within 5 millimetres upstream of an interface between the hollow tubular element and the tobacco rod; and wherein the line of weakness includes an embossed line, a debossed line, a crease, a line of perforation holes, or combinations thereof.

2. A smoking article according to claim 1, wherein the hollow tubular element has a thickness (t) perpendicular to a longitudinal direction of the smoking article of from about 100 micrometers to about 700 micrometers.

3. A smoking article according to claim 1, wherein the hollow tubular element has a length of from about 3 millimetres to about 20 millimetres.

4. A smoking article according to claim 1, wherein the hollow tubular element has a length that is greater than or equal to a length of the portion of the tobacco rod that is circumscribed by the tipping wrapper.

5. A smoking article according to claim 1, wherein a flavour delivery mechanism is provided on the inner surface of the hollow tubular element, and configured to release flavourant when a consumer extinguishes the smoking article.

6. A smoking article according to claim 5, wherein extinguishment initiates one or more trigger events that result in the flavour delivery mechanism releasing flavourant, the one or more trigger events being selected from the group consisting of the application of frictional force, the addition of moisture, a change of pH, a temperature increase, and any combination thereof.

7. A smoking article according to claim 1, wherein the hollow tubular element is formed from a plurality of spirally wound paper layers.

8. A smoking article according to claim 1, wherein the hollow tubular element is formed from an annular shaped segment of filtration material.

9. A smoking article according to claim 1, wherein the hollow tubular element has a thickness (t) perpendicular to the longitudinal direction of the smoking article, and a diameter (D) perpendicular to the longitudinal direction of the smoking article, and wherein the diameter (D) to thickness (t) ratio is less than about 40.

10. A smoking article according to claim 1, wherein the filter further comprises a filter wrapper circumscribing at least the hollow tubular element and the first segment of filtration material, the filter wrapper being disposed between the tipping wrapper and the hollow tubular element and the first segment of filtration material.

11. A smoking article according to claim 1, wherein the tobacco rod comprises a crimped tobacco cast leaf at the downstream end of the tobacco rod.

12. A smoking article according to claim 1, wherein the filter further comprises one or more second segments of filtration material downstream from the first segment of filtration material.

13. A smoking article according to claim 1, wherein a stiffness of the hollow tubular element is greater than or equal to the stiffness of the tobacco rod.

14. A smoking article according to claim 1, wherein the line of weakness is an embossed line.

15. A smoking article according to claim 1, wherein the line of weakness is a debossed line.

16. A smoking article according to claim 1, wherein the line of weakness is an crease line.

17. A smoking article according to claim 1, wherein the line of weakness is a line of perforation holes.

* * * * *